US005106165A

United States Patent [19]

Lattman

[11] Patent Number: 5,106,165

[45] Date of Patent: Apr. 21, 1992

[54] FRAGMENTATION APPARATUS

[76] Inventor: William Lattman, 1769 Larch Street, Prince George, British Columbia, Canada, V2L 1V4

[21] Appl. No.: 589,272

[22] Filed: Sep. 28, 1990

[30] Foreign Application Priority Data

Mar. 30, 1990 [CA] Canada ..... 2013540

[51] Int. Cl.[5] ..... E01H 5/12

[52] U.S. Cl. ..... 299/25; 299/89; 37/222; 37/242; 37/142 R; 172/554; 172/785

[58] Field of Search ..... 37/219, 221, 222, 223, 37/241, 242, 142 R, 244; 299/25, 24, 88, 89; 172/540, 554

[56] References Cited

U.S. PATENT DOCUMENTS

| | | | |
|---|---|---|---|
| 2,197,549 | 4/1940 | Hargrave et al. | 172/785 |
| 2,653,806 | 9/1953 | Robbins | 299/89 |
| 2,738,602 | 3/1956 | Meeks | 37/142 R |
| 3,732,023 | 5/1973 | Rank et al. | 404/90 |
| 3,737,199 | 6/1973 | Stephenson | 299/89 |
| 3,853,419 | 12/1974 | Bertram et al. | 404/121 |
| 3,867,052 | 2/1975 | Durham | 404/121 |
| 3,891,341 | 6/1975 | Trainor et al. | 404/121 |
| 3,922,106 | 11/1975 | Caron et al. | 404/121 |
| 4,074,942 | 2/1978 | Cochran | 404/121 |
| 4,294,183 | 10/1981 | Morgan | 37/223 |
| 4,329,798 | 5/1982 | Edwards | 37/142 R |
| 4,530,620 | 7/1985 | McCartney | 404/121 |
| 4,668,122 | 5/1987 | Riddle | 404/121 |

FOREIGN PATENT DOCUMENTS

| | | | |
|---|---|---|---|
| 395550 | 1/1974 | U.S.S.R. | 172/785 |
| 765452 | 9/1980 | U.S.S.R. | 37/242 |
| 1458474 | 2/1989 | U.S.S.R. | 37/244 |

*Primary Examiner*—Randolph A. Reese
*Assistant Examiner*—Arlen L. Olsen

[57] ABSTRACT

A layer of material such as pavement or sheet ice coating the surface of a roadway is efficiently removed using apparatus that includes a longitudinal tube in a breaker assembly which is rotatably carried by a control frame beam that depends from an articulate hydraulic lift and tilt mechanism of a road grader. Coaxially attached to the tube and uniformly distributed along its length, a number of retainer rings each carry several radially extended teeth that function to fragment the layer. Each tooth includes a tip portion with a free end that penetrates and punctures the layer and a trailing divergent portion which enters the puncture and translates a linear force applied thereto into a radial outward force that fractures and fragments the side walls of each puncture when the breaker assembly is lowered onto the layer and a downward force is applied to each tooth as the breaker assembly rolls over the layer surface.

12 Claims, 4 Drawing Sheets

FRAGMENTATION APPARATUS

FIELD OF THE INVENTION

This invention relates to apparatus and a to a related method for breaking a surface layer of frangible material and more particularly to a breaking tooth that is adapted to laterally fracture and fragment the surface layer by exerting a downward force thereagainst.

BACKGROUND OF THE INVENTION

A known method for removal of sheet ice from roadways and paved streets commonly employs a road grader having a depending blade that is used to push and consequently fracture the sheet ice. Ice breakage usually results in large slabs which are subsequently collected and loaded onto suitable vehicles for transportation to a disposal site. Depending upon ice thickness, the broken slabs can be both heavy and unwieldy. As a result, collection and dispersal of the slabs can be difficult and expensive, requiring large machinery for ice handling and transportation.

Furthermore, the forces required to remove ice in this manner are extreme and would likely require the use of tire chains on the road grader to provide sufficient traction. This means additional time for mounting and demounting the chains which extends the time that the road grader is out of service and further adds to the cost of ice removal under these conditions. Conceivably, unusually large thicknesses of sheet ice may even preclude removal thereof if adequate traction for the road grader is not present.

The breakup and removal of road pavement is similar except that one or more raker teeth carried by the road grader ahead of the blade are employed to uplift and fracture the pavement. This also requires the application of an extreme pushing force.

SUMMARY OF THE INVENTION

Having regard to the aforedescribed problems recognized in breaking and removing a surface layer of frangible material such as pavement or sheet ice from a road surface, one provision of the present invention is apparatus that will effectively fragment the pavement or ice coating irrespective of its thickness.

Another provision of the invention is apparatus that will function effectively to break and remove the pavement or sheet ice from a roadway with reduced energy requirements.

Still another provision of the invention is ice removal apparatus that may be made operational with a minimum of delay.

A further provision of the invention is apparatus that will sequentially fracture and fragment pavement, ice or any frangible layer on a roadway into a particulate form, instead of slabs, to simplify handling and transportation.

The problems associated with the prior art may be substantially overcome and the foregoing provisions achieved by recourse to the invention which, in one aspect, relates to apparatus for fragmenting a frangible layer. The apparatus comprises tip means having a free end adapted to penetrate and puncture the layer, wedge means joining and divergingly trailing the tip means for entering the puncture and exerting a radially outward force capable of fracturing the side walls thereof, and attachment means for fixedly securing the divergent free end of the wedge means onto pressure means adapted to apply a linear force thereagainst. The linear force is sufficient to puncture the layer by means of the tip means and to force entry of the wedge means into the puncture to effect fracturing and fragmentation of the layer by the apparatus.

Another aspect of the invention relates to a method for fragmenting a frangible layer which comprises the steps of, penetrating and puncturing the layer in a predetermined pattern to form a plurality of apertures having radial side walls, inserting in each aperture means for translating a predetermined linear force applied thereto into a radial outward force capable of fracturing the radial side walls of the aperture, and applying the linear force to each translation means to effect fracturing the radial side walls and fragmenting the layer by the apparatus.

BRIEF DESCRIPTION OF THE DRAWINGS

The invention will now be more particularly described with reference to embodiments thereof shown, by way of example, in the accompanying drawings in which.

DETAILED DESCRIPTION OF THE PREFERRED EMBODIMENTS

The invention described hereinbelow functions substantially in the same manner to fragment any surface layer of frangible material disposed on a roadway. This would include ice, pavement including asphalt, macadam and concrete, compacted soil, clay and the like to list but a few examples. In the interest of brevity, however, the following description has been arbitrarily restricted to embodiments of the invention related to ice removal from paved streets and roadways.

The following remarks therefore constitute a sufficient description to individuals skilled in the art of ice breaking apparatus for a comprehensive understanding of the best mode contemplated to give effect to the embodiments of the invention as disclosed and claimed herein.

Figure 1:
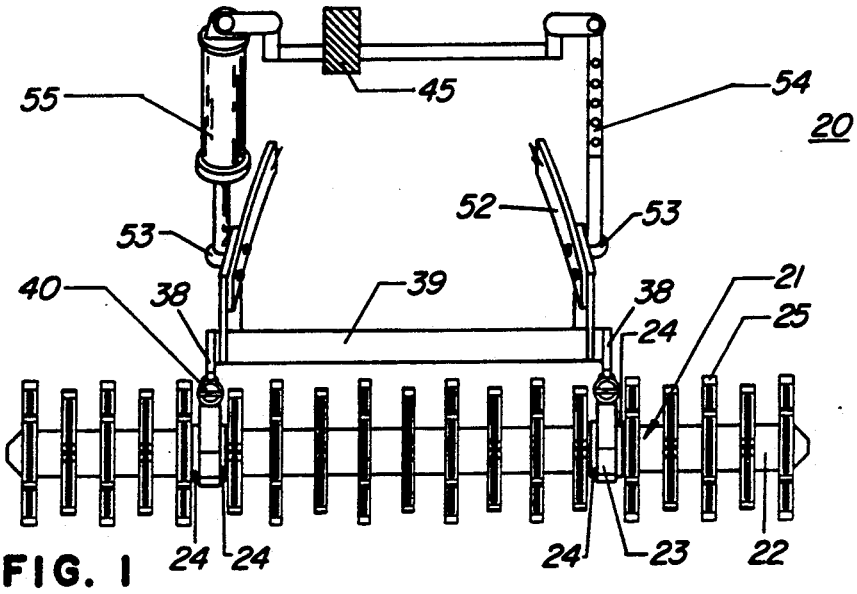
FIG. 1 is a front elevation diagrammatic view of ice fragmenting apparatus in accordance with the invention, shown mechanically suspended from an optional tilt system.

One embodiment of apparatus 20 having utility in fragmenting an ice coating is shown in FIG. 1 as comprising a breaker assembly 21 that includes a rigid longitudinal tube 22 which is rotatably journalled in a pair of sleeve bearings 23. The tube 22 is constructed of high tensile strength steel tubing to withstand the stresses imposed thereon and is configured with an outside diameter of 14 cm, an inside diameter of 12 cm, and an overall length of 244 cm.

A plurality of thrust washers 24 are welded onto the tube 22 in coaxial relation therewith. It will be seen in FIG. 1 that one washer 24 is positioned on each side of individual ones of the bearings 23 to prevent side movement of the assembly 21. The thrust washers 24 are fabricated with a sufficiently large outside diameter so as to function effectively as deflectors to prevent the ingress of dirt and foreign matter generally and also as means for grease retention within the bearings 23. In this regard, any lubricant escaping past the thrust washers 24 also serves to lubricate the side thrust surfaces of the bearings 23. The washers 24 are preferably flame cut from 13 mm thick T-1 steel, having an outside diameter of 21.6 cm and an inside diameter of 13.3 cm. The distance between each pair of washers 24 is set at 6.4 cm to accommodate one bearing 23. A center-to-center distance between both bearings 23 is 126 cm.

Longitudinally distributed along the tube 22 in uniformly spaced relation are nineteen retainer rings 25. It will be observed that nine of the rings 25 are positioned between the bearings 23 and that five additional rings 25 are disposed along the tube 22 outwardly of each bearing 23.

The rings 25 are cast from high tensile strength steel and are of unitary construction with six, radially extended tapered protrusions shown as retaining points 26. The function of the points 26 is to retain corresponding spike teeth 27, hereinbelow described in greater detail.

Figure 12:
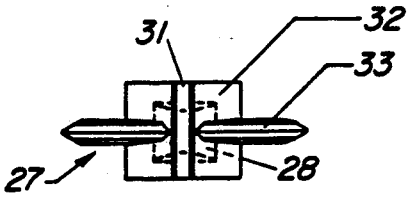
FIG. 12 is a top plan view of an ice breaking tooth in accordance with the invention.
Figure 13:
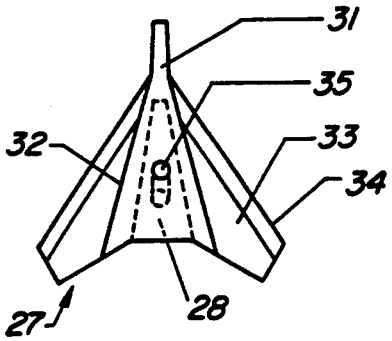
FIG. 13 is a side elevation view of the tooth of FIG. 12.
Figure 14:
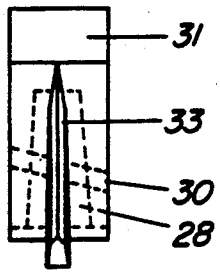
FIG. 14 is an end view of the tooth of FIG. 13.

One embodiment of a spike tooth 27 (FIGS. 12–14) achieves retention on a corresponding point 26 by means of an interference taper fit. Attainment of such fit is by means of a matching taper fit between a tooth 27 and its corresponding point 26. In this respect, it will be understood that side walls of the tooth 27 define a cavity 28 which is shaped to mate with a point 26. Each tooth 27 is driven onto its corresponding point 26 by means of a hammer.

Figure 11:
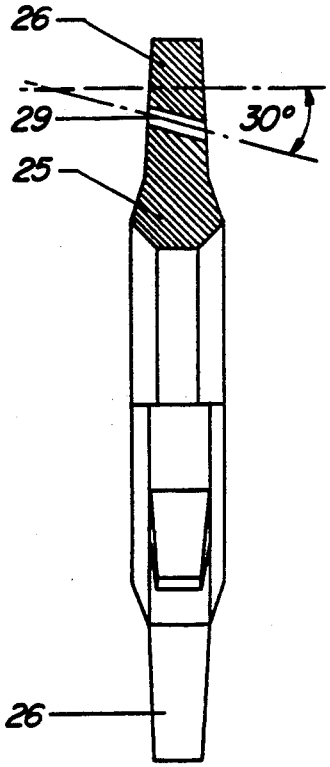
FIG. 11 is an end view of the retainer ring of FIG. 10, shown partly in cross-section.

In addition to the taper fit, an added safety precaution is provided to ensure tooth retention. This is achieved by a retaining lock pin disposed in a lateral bore 29 traversing the point 26 in registry with a corresponding bore 30 in the tooth 27. Secondary retention for each tooth 27 is thus provided by a rolled spring pin 35 of known construction which is driven through the aligned bores 29 and 30. To facilitate convenient installation of the pins 35, the bores 29 and 30 are disposed at a 30° angle with respect to a horizontal plane as may be seen in FIG. 11. It has been determined that a rolled spring pin having an, outside diameter of 9.5 mm and a length of 44.5 mm performs adequately as secondary retention means. Under extreme operating conditions, however, the foregoing pin size may be inadequate, in which case dimensional increases of the bores 29 and 30 and pins 35 will compensate for the particular conditions encountered.

The tooth 27 is preferably cast from high tensile strength steel that is both impact and abrasion resistant and may be welded in position as an alternative means of mounting on the rings 25. The tooth 27 is fabricated with a width of 6.4 cm and includes a straight tip 31 that functions to initially penetrate and puncture an ice coating on contact. It will understood that the tip 31 has straight sides so as to facilitate tooth maintenance. As the tip wears under abrasive conditions, the tip may be rebuilt with weld deposited metal, and then case hardened to extend tip edge service life.

Joined to and divergingly trailing the tip 31 is a wedge shaped body 32 that is 11.4 cm in length, with the overall length of the tooth 27 being 14 cm. The function of the wedge shaped body 32 is to translate a linear force applied thereto, such as the suspended weight of the apparatus 20, into a radial force. This linear force is sufficient in magnitude to puncture the ice coating by means of the free end of the tip 31 and also to force entry of the body 32 into the puncture so as to effect fracturing the radial side walls thereof via the radial force. These sequential steps occur as the tooth 27 travels through its arc of rotation. It will be understood, of course, that other forces are involved in ice breaking via the embodiments of the invention described herein. For example, a rotational force is applied to the side walls of each aperture which further assists in fracturing and fragmenting the ice coating. In the embodiments described, test trials have shown that the tooth 27 has the capability of breaking an ice layer 20 cm thick with only 13 cm of actual tooth penetration.

It will be understood that the tooth 27 as described hereinabove functions adequately in fracturing and fragmenting an ice coating. However, to reduce the size of fragments broken away from the ice coating, the tooth 27 is provided with an integral pair of cutting fins 33. It will be observed that each pair of fins are disposed in a common plane with each fin outstanding orthogonally from a corresponding sloping wall of the body 32. The fins 33 are provided with sharp leading edges 34 that function to shear the side walls of a puncture. As a result of such shearing action, each fragment broken away from the ice coating by the tooth 27 is cut in half to facilitate subsequent handling.

Figure 2:
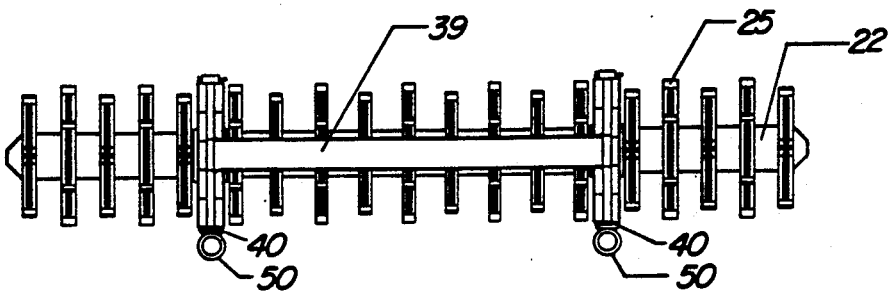
FIG. 2 is a top plan view of the ice fragmenting apparatus of FIG. 1 shown coupled to a control frame beam.
Figure 3:
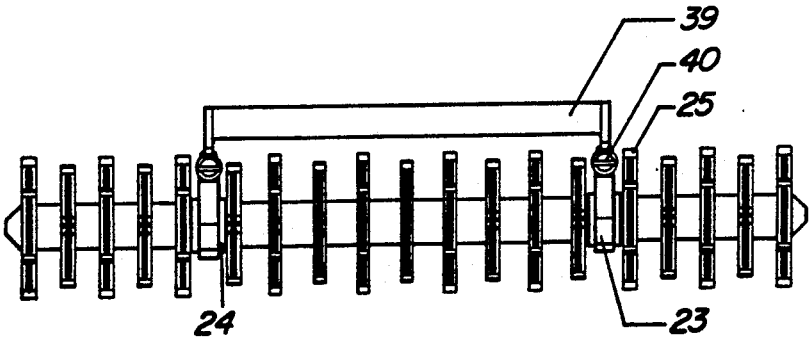
FIG. 3 is a front elevation view of the apparatus of FIG. 2.
Figure 4:
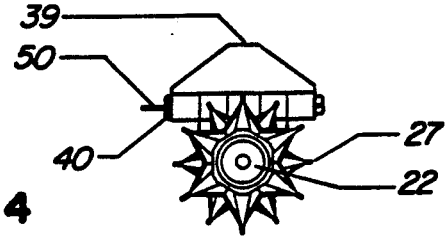
FIG. 4 is a side elevation view of the apparatus of FIG. 3.
Figure 7:
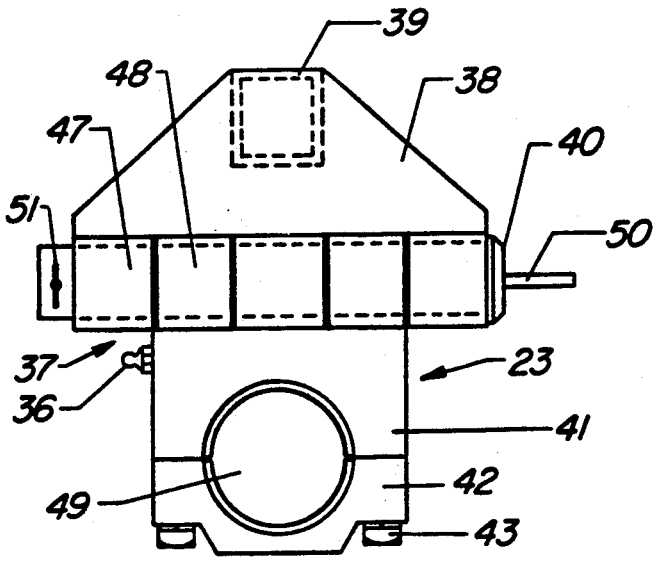
FIG. 7 is a side elevation view of a bearing assembly used in the apparatus of FIG. 1.
Figure 8:
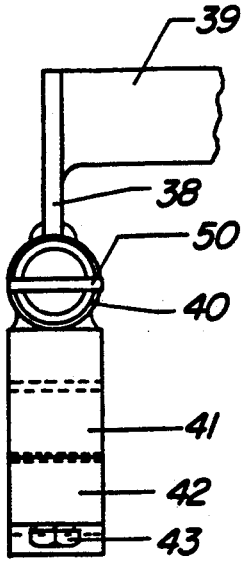
FIG. 8 is an end view of the bearing assembly of FIG. 7.
Figure 9:
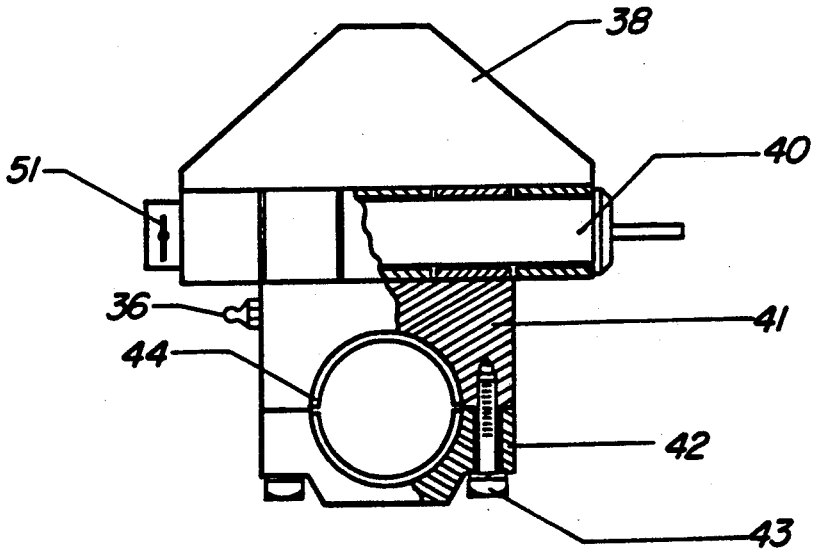
FIG. 9 is a side elevation view corresponding to the view of FIG. 7, with portions cut away to reveal part of the inner structure.
Figure 10:
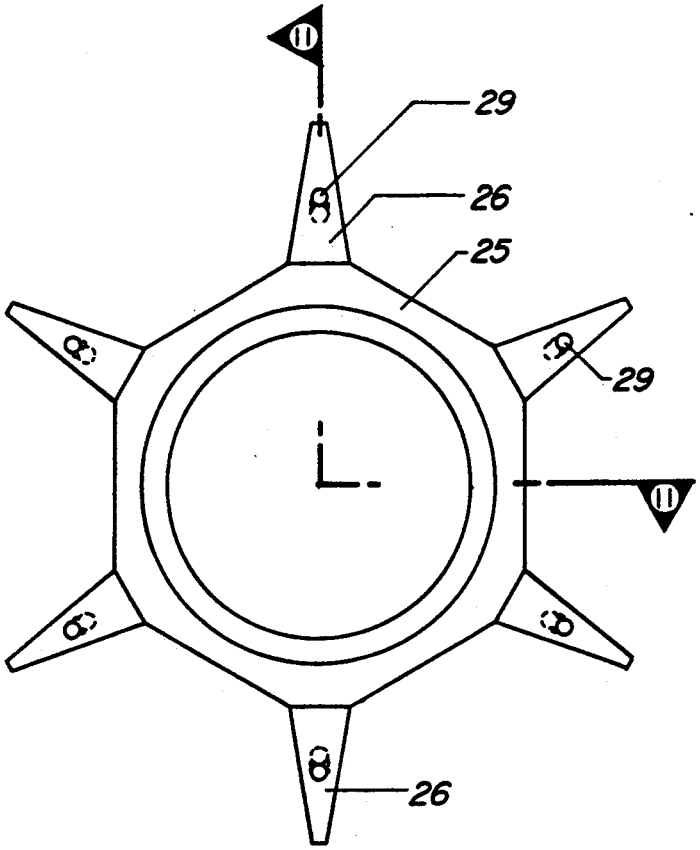
FIG. 10 is a side elevation view of a retainer ring forming part of the apparatus of FIG. 1.

Reference to FIGS. 1–3 shows that each bearing 23 depends from an end flange 38 which is connected, as by welding, to respective ends of a control frame beam 39. As best seen in FIGS. 7 and 9, each bearing 23 is mechanically joined to its flange 38 by means of a hinge 37 configuration that is locked together by a connecting pin 40.

Each bearing 23 comprises an upper bearing block 41 and a lower bearing block 42. Both blocks are preferably flame cut from 6.4 cm thick mild steel. The overall dimensions of the assembled blocks are 25.4 cm in height and 27.9 cm in width. A central hole, 16.8 cm in diameter, functions as a bearing bore 49 lined with bearing material hereinbelow described in greater detail.

It will be understood that the bearing bore 49 is machined off-set by 2.5 cm. The purpose of this off-set is to insure that the block 42 protrudes as little as possible below the tube 22 to provide greater ground clearance. Both blocks 41 and 42 are joined mechanically in a known manner and, as illustrated in the cutaway portion in FIG. 9, it will be seen that the blocks are joined by a pair of threaded bolts 43, a suitable size being NC 2.5 cm × 14.6 cm.

A pair of bearing shells 44 line the bore 49 of each bearing 23 and are fabricated from "Tubular Blue Nylon" stock which is known to have good wear qualities. Nylon tube sections 6.4 cm in length are cut from the stock and are subsequently grooved along inner and outer circumferences to provide a pair of centrally positioned coplanar grease grooves, not shown. A plurality of apertures, not shown, are equally spaced along the periphery of the outer grease groove in communication with the inner groove. This provides a series of passageways for conducting lubricant between the inner and outer grooves in order to provide lubrication between the inner surfaces of the shells 44 and the corresponding bearing surfaces of the tube 22. A grease nipple 36 is in communication with the outer grease groove to supply the lubricant from a grease gun, not shown.

Although not indicated in the drawings, it will be understood that the shells 44 are locked to their respective blocks 41 and 42 by means of dowels that engage a pair of the lubrication apertures between the inner and outer grease grooves.

Mechanically connecting the bearings 23 to the beam 39 by means of the pins 40 permits quick detachment of the assembly 21 while retaining the beam 39 and its related components in place. The ability to quickly detach the assembly 21 is desirable when it is not required as, for example, when encountering deep snow. The assembly 21 is then readily removed to avoid interference with the snow passing under the road grader 45 to its scraper blade 46.

The beam 39 is preferably fabricated from thick wall, 10 cm square steel tubing and has attached to its free ends the flanges 38 as aforedescribed. The hinge 37 between each flange 38 and its corresponding bearing 23 comprises three connection bushings 47 which are welded to the lowermost edge of the flange 38. The bushings 47 are coaxially aligned and are spaced apart to interleave with corresponding bushings 48 that are welded to the uppermost edge of the block 41. In the embodiment illustrated, each bushing has an outside diameter of 7.6 cm, an inside diameter of 5.1 cm and a length of 7.6 cm.

The connecting pins 40 are sized to slidably engage the bushings 47 and 48. One end of the pin 40 has welded thereto a large washer 50 to facilitate pin removal with a tool bar, not shown. The opposite end of the pin 40 extends outwardly of the bushings 47 and includes a traversing aperture to accommodate a cotter pin 51 that secures the pin 40 within the hinge 37 following installation.

As may be seen in FIG. 1, mounting brackets 52 are attached to the beam 39 as by welding and will vary in configuration and specific dimensions to accommodate various models of road graders, and the like, with which the assembly 21 may be used.

In order to controllably exert a linear downward pressure onto the assembly 21, known scarifier actuating apparatus is used. This requires the installation of known trunnion balls 53, located as shown in FIGS. 1, 5 and 6.

Figure 5:
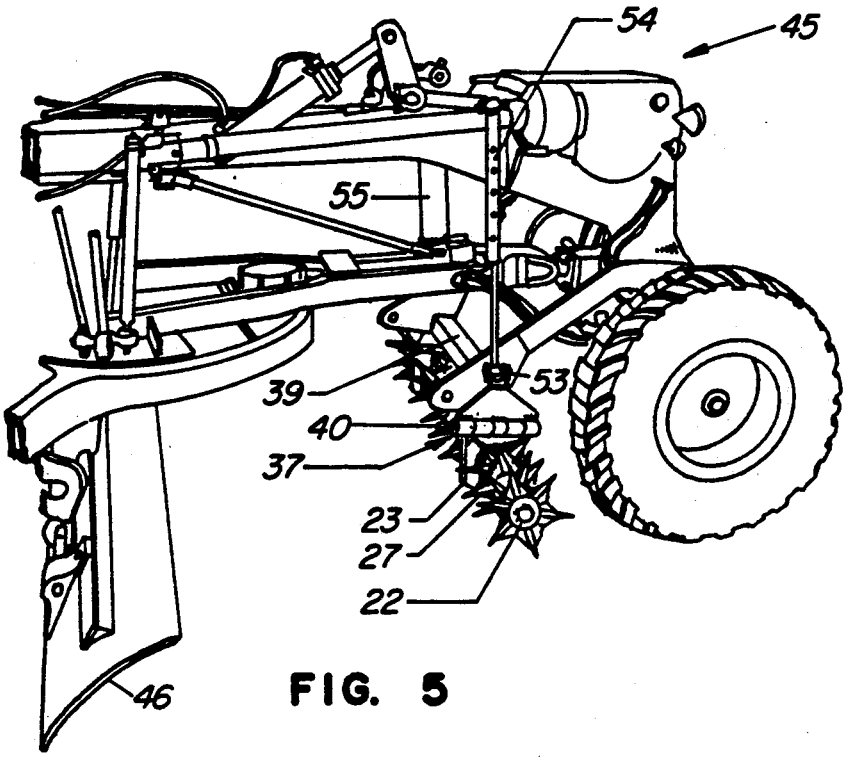
FIG. 5 is a partial perspective view of a road grader on which is operationally mounted the apparatus of FIG. 1.
Figure 6:
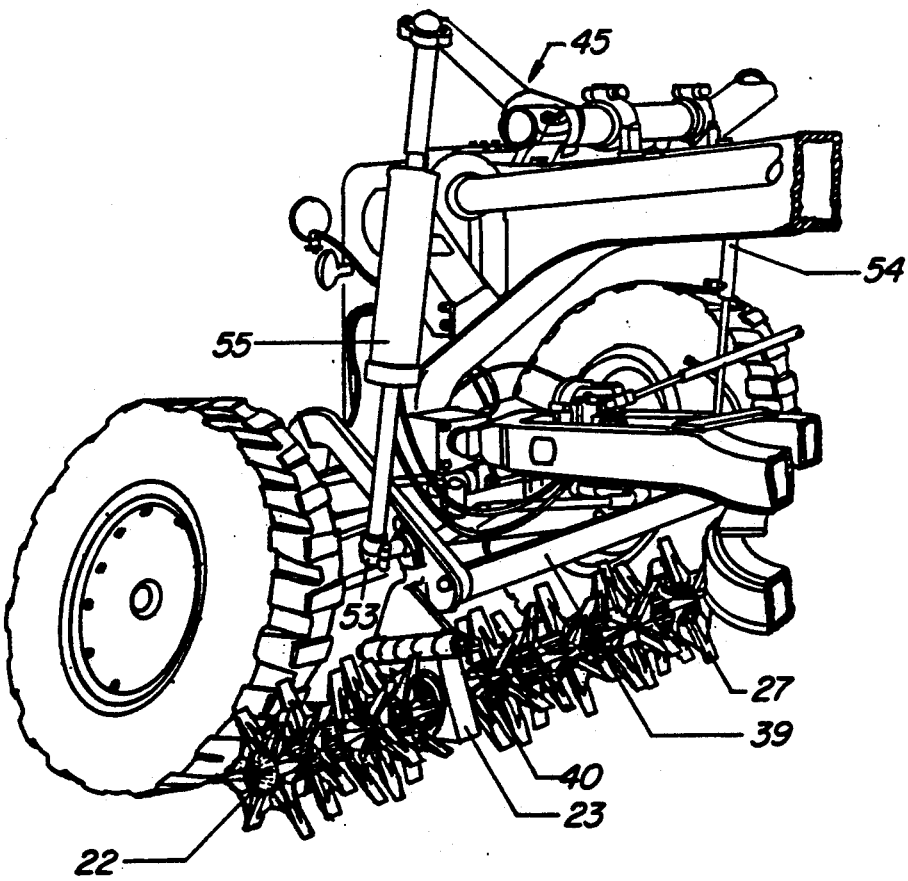
FIG. 6 is a partial perspective side view of the apparatus of FIG. 5 showing the opposite side thereof with a hydraulic actuating cylinder appearing in the foreground.

FIGS. 5 and 6 illustrate the assembly 21 installed on the grader 45 by means of an optional tilt system. This system permits the grader operator to tilt the assembly 21 to either the right or to the left in relation to the grader, as opposed to merely an up and down relationship.

A diagrammatic representation of the tilt system is shown in FIG. 1 wherein it will be seen that the assembly 21 is suspended from the grader 45 by a pushrod 54, which forms part of the scarifier system, together with a hydraulic tilt cylinder 55 to provide the aforedescribed up-and-down movement. It will be understood that various mechanical couplings, torque links, control valves, hoses, lines, and fittings would be required to accommodate a specific installation of the optional tilt system and would be known to those skilled in the art.

As illustrated in FIG. 1, the cylinder 55 is used in place of a passive left actuating pushrod corresponding to the right pushrod 54. Regardless of predetermined locations required for its installation on any suitable road grader, the cylinder 55 should be positioned and/or modified so that an equal vertical travel distance is provided for the assembly 21 above and below a horizontal plane. In this respect, an operational tilt range of from 18° to 20° to the left and right is expected to be adequate.

All specifications hereinabove expressed are for a Caterpillar* grader, model 14E, but may be modified as required to fit other types of equipment such as loaders, skidders, trucks and the like. In any given instance, the fundamental structures of the embodiments described herein remain the same, with differences occurring mainly in dimensions to accommodate the equipment used.

*Trade Mark

To those individuals skilled in the art to which this specification is addressed, it will be apparent that the embodiments heretofore described may be varied to meet particular specialized requirements without departing from the true spirit and scope of the invention disclosed. For example, where the tooth 27 has been described as being wedge shaped with a square edged tip, the tip may be modified in the form of a chisel shaped tip. Alternatively, the tip 31 could be cylindrical in form with the body 32 portion in the shape of a frustum of a cone. The foregoing embodiments are therefore not to be taken as indicative of the limits of the invention but rather as exemplary structures of the invention which is described by the claims appended hereto.

The embodiments of the invention in which an exclusive property of privilege is claimed are defined as follows:

1. Apparatus for fragmenting a frangible layer comprising:

a solid chisel tip defined substantially by flat surfaces disposed in mutually opposed parallel relation with a free end adapted to penetrate and puncture the layer;

a rectilinear wedge member joined to and divergingly trailing the tip for entering the puncture and exerting a radially outward force capable of fracturing the side walls thereof, the member having a pair of flat first side walls spaced apart in substantially parallel relation, and a pair of flat second side walls disposed orthogonally to the first side walls for defining a correspondingly wedge shaped chamber closed at the convergent end and open at the divergent free end;

fin means disposed along a portion of each second side wall, the fin means including a sharp leading edge adapted to shear the side walls of the puncture; and attachment means for fixedly securing the divergent free end of the wedge member onto pressure means adapted to apply a linear force there against, the linear force being sufficient to puncture the layer by the tip, to force entry of the wedge member into the puncture, and to effect fracturing and fragmentation of the layer by the apparatus.

2. Apparatus as claimed in claim 1, further comprising an aperture in each first side wall disposed about a common axis.

3. Apparatus as claimed in claim 2, wherein the fin means comprise a pair of fins disposed in a common plane, with each fin outstanding orthogonally from a corresponding second side wall.

4. Apparatus as claimed in claim 3, further comprising a retainer ring defined by a pair of annular side walls disposed in spaced parallel relation, a cylindrical inner wall adapted to be mounted on a shaft, and a radial outer wall on which are fixed a plurality of equidistant radial projections.

5. Apparatus as claimed in claim 4, wherein each projection provides a tapered interference fit with the chamber of a corresponding wedge member mounted thereon, thereby forming a breaker wheel having a plurality of teeth radially outstanding from the outer wall.

6. Apparatus as claimed in claim 5, wherein each projection includes a lateral bore therethrough aligned in registry with the apertures in both first side walls of the wedge member and further comprising a locking pin disposed within the apertures and bore of individual ones of the teeth.

7. Apparatus as claimed in claim 6, further comprising:

a longitudinal roller tube along which a plurality of equidistantly spaced breaker wheels are fixedly mounted in coaxial relation;

bearing means in which the tube is journalled to rotate horizontally; and frame means supporting the roller tube and bearing means.

8. Apparatus as claimed in claim 7, further comprising:

means fixedly connecting the bearing means to the frame means; and tilt means connected intermediate the frame means and a scarifier actuating system for tiltably supporting the frame means.

9. Apparatus as claimed in claim 8, further comprising the scarifier actuating system and a road grader from which the system is operably suspended.

10. A method for fragmenting a frangible layer, comprising the steps of:

penetrating and puncturing the layer with a solid chisel tip defined substantially by flat surfaces disposed in mutually opposed parallel relation with a free end adapted to penetrate and puncture the layer in a predetermined pattern to form a plurality of apertures having radial side walls;

inserting into each aperture a rectilinear wedge member joined to and divergingly trailing the tip for exerting a radially outward force capable of fracturing the radial side walls, the member having a pair of flat first side walls spaced apart in substantially parallel relation, a pair of flat second side walls disposed orthogonally to the first side walls for defining a correspondingly wedge shaped chamber closed at the convergent end and open at the divergent free end;

shearing the side walls of the puncture with fins means disposed along a portion of each second side wall, the fin means including a sharp leading edge; and applying a linear force to the divergent free end of each wedge member, to force entry of the wedge member into the puncture, and to effect fracturing the radial side walls and fragmenting the layer within the predetermined pattern.

11. A method as claimed in claim 10, comprising the further step of progressively advancing the predetermined pattern to form a continuous path in which the layer is fragmented.

12. A method as claimed in claim 11, comprising the further step of progressively scraping the fragmented layer away from and to one side of the path.

* * * * *